US008662090B2

(12) United States Patent
Gueret

(10) Patent No.: US 8,662,090 B2
(45) Date of Patent: Mar. 4, 2014

(54) MASCARA BRUSH

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 926 days.

(21) Appl. No.: 12/000,822

(22) Filed: Dec. 18, 2007

(65) Prior Publication Data

US 2008/0184512 A1 Aug. 7, 2008

Related U.S. Application Data

(60) Provisional application No. 60/886,189, filed on Jan. 23, 2007.

(30) Foreign Application Priority Data

Dec. 18, 2006 (FR) ..... 06 55611

(51) Int. Cl.
*A45D 40/26* (2006.01)

(52) U.S. Cl.
USPC ..... 132/218

(58) Field of Classification Search
USPC ..... 132/218, 317, 318, 320; 15/206; 401/125–129
See application file for complete search history.

(56) References Cited

U.S. PATENT DOCUMENTS

| | | | | |
|---|---|---|---|---|
| 5,853,011 | A | 12/1998 | Gueret | |
| 5,860,432 | A | 1/1999 | Gueret | |
| 5,894,847 | A | 4/1999 | Gueret | |
| 6,099,183 | A | 8/2000 | Gueret | |
| 6,390,708 | B1 | 5/2002 | Gueret | |
| 6,494,215 | B2 | 12/2002 | Gueret | |
| 6,655,390 | B2 | 12/2003 | Gueret | |
| 7,077,592 | B2 | 7/2006 | Gueret | |
| 2002/0020426 | A1 * | 2/2002 | Gueret | 132/218 |
| 2002/0124860 | A1 | 9/2002 | Gueret | |
| 2004/0134507 | A1 | 7/2004 | Gueret | |
| 2004/0168698 | A1 | 9/2004 | Gueret | |
| 2004/0240926 | A1 | 12/2004 | Gueret | |

FOREIGN PATENT DOCUMENTS

| | | |
|---|---|---|
| EP | 0 611 170 | 8/1994 |
| EP | 1 236 420 | 9/2002 |
| EP | 1 424 024 | 6/2004 |
| EP | 1 169 941 | 8/2005 |
| FR | 2 749 489 | 12/1997 |
| FR | 2 749 490 | 12/1997 |
| FR | 2 810 860 | 1/2002 |
| FR | 2811525 | 1/2002 |
| FR | 2 836 031 | 8/2003 |
| WO | WO 01/05273 | 1/2001 |

OTHER PUBLICATIONS

French Search Report dated Aug. 15, 2007.
U.S. Appl. No. 12/000,419, filed Dec. 12, 2007.

* cited by examiner

*Primary Examiner* — Rachel Steitz
(74) *Attorney, Agent, or Firm* — Oliff PLC

(57) ABSTRACT

The present disclosure relates to an applicator for applying a composition to eyelashes and/or eyebrows. The applicator may include a brush comprising bristles and a core having a rectilinear portion from which the bristles extend, the bristles having free ends that define an envelope surface. The envelope surface may extend along a longitudinal axis that is not parallel to the longitudinal axis of the rectilinear portion of the core, and may have at least one cross-section having a shape that is flattened along a mid-plane, the envelope surface defining at least one face that is parallel to the longitudinal axis of the core.

26 Claims, 5 Drawing Sheets

MASCARA BRUSH

This application claims the benefit of U.S. Provisional Application No. 60/886,189, filed Jan. 23, 2007. This application also claims the benefit of priority under 35 U.S.C. §119 to French Patent Application No. 06 55611, filed Dec. 18, 2006.

The present disclosure relates to applicators for applying a composition, such as a cosmetic, makeup, or care product, e.g. mascara, to eyelashes and/or eyebrows.

The present disclosure relates, more particularly, to an applicator comprising a stem that extends along a longitudinal axis, and a brush that is fastened to the stem, the brush comprising a core and bristles that extend from the core.

BACKGROUND

French patent applications FR-A-2 749 489 and FR-A-2 749 490 disclose brushes that have non-rectilinear cores, e.g. that are shaped to match the curve of the eye. Such brushes can be unsuitable for some users, since the curve of the brush sometimes requires the user to perform strokes that certain people find difficult.

Patent application EP-A2-1 236 420 discloses a brush having a core that is curvilinear over at least a fraction of its length, the free end of the brush not being in alignment with the axis of the stem. During manufacture and/or use of this brush with a receptacle containing a composition, such a brush sometimes can be relatively difficult to insert into, and/or remove from, the neck of the receptacle.

European patent application EP-A-1 424 024 discloses an applicator comprising a brush having a core that includes a portion carrying the bristles, wherein the longitudinal axis of the portion of the core carrying the bristles forms a non-zero angle of less than 20° with the longitudinal axis of the distal portion of the stem.

Such a brush sometimes requires the user to adapt brush strokes that are used, since the brush sometimes does not enable the user to comb the eyelashes or the eyebrows in the same manner as with a conventional brush that has a core that does not slope relative to the longitudinal axis of the stem.

U.S. Pat. No. 5,853,011 discloses a mascara brush including a cutback portion having a width that varies along the brush. The cutback portion may have a single maximum width.

French patent application FR-A-2 811 525 discloses off-center brushes, some having a core that extends in alignment with the stem and along the longitudinal axis of the stem, the brush having faces that form a non-zero angle with the longitudinal axis of the core. The longitudinal axis of the core and the longitudinal axis of the envelope surface of the brush are generally non-coplanar given the slope of the faces.

A potential drawback of the off-center brushes of FR-A-2 811 525 is that these brushes have an external appearance that sometimes can be disconcerting to the user. In addition, these brushes sometimes are not wiped symmetrically from one end of the brush to the other, thereby causing flattening over continued use.

Brushes are also known that have envelope surfaces with cross-sections that are off-center relative to a core, and that have faces or ridges that all extend substantially parallel to the core.

The bristles of such brushes are implanted in a conventional manner, wherein the faces are cut parallel to the core. Therefore, in such brushes, the longitudinal axis of the envelope surface is parallel (albeit off-center) to the longitudinal axis of the core. Having this shape does not make these envelope surfaces easy to use, nor does having this shape make it possible to obtain desired effects in making up and in engaging eyelashes or eyebrows to lengthen, separate, and curl them. For example, it is often difficult to apply makeup to, and/or comb, eyelashes or eyebrows situated towards the sides of the eye, with the portion of the envelope surface that is widest along the core.

SUMMARY

Thus, there exists a need for improved, possibly easier to use, applicators for applying a composition to eyelashes and/or eyebrows, in particular, in terms of spreading the composition and/or lengthening and/or curling eyelashes or eyebrows. The presently disclosed device seeks to satisfy one or more of these needs.

In the following description, certain aspects and embodiments of the present invention will become evident. It should be understood that the invention, in its broadest sense, could be practiced without having one or more features of these aspects and embodiments. In other words, these aspects and embodiments are merely exemplary.

In one aspect, an applicator for applying a composition to eyelashes and/or eyebrows is provided, wherein the applicator comprises a brush having bristles and a core having a rectilinear portion from which the bristles extend. The bristles may have free ends that define an envelope surface. The envelope surface may extend along a longitudinal axis (i.e., an envelope longitudinal axis) that is not parallel to a longitudinal axis of the rectilinear portion of the core (i.e., a core longitudinal axis). The envelope surface may have, at at least one portion along the envelope longitudinal axis, at least one cross-section having a shape that is flattened along a midplane. The envelope surface may define at least one face that is parallel to the longitudinal axis of the core.

By having at least one face that is parallel to the core, the brush may be less disconcerting to users in spite of its off-center character, and may encourage the application of makeup as with a conventional brush of cylindrical envelope surface having a generator line that is parallel to the longitudinal axis of the stem. At least some embodiments of he disclosed applicator may be easy to use, even for a person who is used to using conventional brushes.

The brush may enable application to be continuous and uniform, and may facilitate separation and curling of eyelashes.

The off-center position of the brush may enable the user to benefit from certain advantages of off-center brushes, in particular in terms of the bristles penetrating into the eyelashes, and in terms of combing the eyelashes.

The rectilinear core may also improve the quality of brush-wiping, enabling wiping to be relatively uniform, which can reduce the risk of the brush being flattened.

Such a brush may also facilitate engagement with eyelashes or eyebrows.

Depending on the orientation of the applicator relative to the eye, and the side of the brush selected for the application, the orientation of the bristles may change and the engagement of the eyelashes or eyebrows by the bristles may be modified. The orientation of the envelope surface of the brush relative to the curvature of the eyelashes or the eyebrows relative to the eye may be better selected by the user, since the envelope surface of the brush may be off-center relative to the stem. For example, it may be desirable to turn the brush through a non-zero angle, e.g. one half of a turn, in order to offer best access to the eyelashes that are situated at each end of the set of eyelashes.

At least some embodiments of the disclosed brush may facilitate lengthening eyelashes and loading eyelashes with composition. For example, the envelope surface may define planar faces that serve to load the eyelashes with composition.

In at least some embodiments, the disclosed brush facilitates two different types of application and combing, with easy ergonomics for switching between the two types by merely turning the brush, e.g., through one fourth or one half of a turn.

The disclosed brush may provide, at one end, e.g. the distal end, bristles of different lengths, e.g. with a difference of more than 10%, or more than 20%, for the length of the long bristles relative to the short bristles.

The longest bristles at the end of the brush could be used to apply makeup to small eyelashes. Bristles of different lengths may present different flexibilities.

A greatest dimension for a cross-section of the brush may be in the range of 5 millimeters (mm) to 13 mm, e.g., in the range of 7 mm to 11 mm or in the range of 8 mm to 10 mm.

The longitudinal axis of the envelope surface may be rectilinear.

The term "longitudinal axis of the envelope surface" (or, stated another way, "envelope longitudinal axis") should be understood as meaning a line, that can be straight, interconnecting at least most, if not all, of the centers of the cross-sections of the envelope surface.

For a circular or regular polygonal cross-section, the center coincides with the center of symmetry. For a cross-section that is non-symmetrical, its center is the center of the smallest symmetrical shape, e.g. a circle or a regular polygon, in which the non-symmetrical cross-section can be inscribed.

For example, if the cross-section of the envelope surface is rectangular with a small setback on a long side of the rectangle, for example, its center is the center of the smallest rectangle in which the cross-section can be inscribed, i.e. that of the rectangle without the setback.

On one side of the core, the brush may include a succession of setbacks in order to create gaps between the bristles, enabling the brush to act like a comb.

The longitudinal axis of the rectilinear portion of the core of the applicator and the longitudinal axis of the envelope surface can be coplanar. The mid-plane can contain the longitudinal axes of the core and of the envelope surface.

By way of example, the longitudinal axis of the envelope surface may form an angle lying in the range 1° to 8° with the longitudinal axis of the rectilinear portion of the core.

At least two points of the rectilinear portion of the core may be situated in the above-mentioned mid-plane. The core may be off-center within a cross-section of the envelope surface taken at each of the two points.

The term "off-center core" should be understood as meaning that the core does not coincide with the center of the cross-section under consideration.

The core may be off-center at least at each of the axial ends of the brush.

The core may be centered at at least one cross-section of the envelope surface of the brush. This cross-section may be situated at the middle of the brush, for example, or it may be situated elsewhere.

In at least some embodiments of the disclosed brush, the envelope surface may have at least one face that is not parallel to the longitudinal axis of the rectilinear portion of the core, e.g. two opposite faces that are not parallel to the longitudinal axis of the rectilinear portion of the core.

The envelope surface may present one or more faces, e.g. two opposite faces, that are parallel to the longitudinal axis of the rectilinear portion of the core.

At least some embodiments of the disclosed brush may thus comprise at least one longitudinal face or ridge, the ridge also being referred to as an edge, that is not parallel to the core of the brush, and at least one longitudinal face or ridge that is parallel to the core of the brush.

The above-mentioned face may be defined geometrically by moving a generator line parallel to itself. At least one of the faces may optionally be defined laterally by longitudinal ridges.

At least one of the faces defined by the envelope surface of the brush may be planar. Alternatively or additionally, at least one of the faces defined by the envelope surface of the brush may be substantially concave or substantially convex.

The envelope surface may define at least one planar face that is parallel to the above-mentioned mid-plane.

The brush may have at least one convex face with a radius of curvature, when the brush is observed in cross-section, that is greater than the length of the longest bristle extending from the core in the cross-section.

A longitudinal section of the envelope surface of the brush may have a shape that is triangular, trapezoidal, hourglass-shaped, rectangular, lens-shaped, or oblong, this list not being limiting.

The envelope surface may be of constant cross-section over substantially the entire length of the rectilinear portion of the core, or it may be of non-constant cross-section over substantially the entire length of the rectilinear portion of the core.

At at least one point of the rectilinear portion of the core, the cross-section of the envelope surface may present a shape that is circular, polygonal, lozenge-shaped, oblong, oval, lenticular (i.e., lens-shaped), wedge-shaped, pear-shaped, keyhole-shaped, stepped, or some other shape, this list not being limiting. Exemplary polygonal shapes for the cross-section of the envelope surface may include, without limitation, triangular, rectangular, square, pentagonal, or hexagonal shapes.

By way of example, a cross-section of the envelope surface may define steps projecting from at least one side of the cross-section of the envelope surface, outwards in register (i.e., in alignment) with a face defined by the envelope surface or perpendicularly to the envelope surface.

The envelope surface of the applicator may be symmetrical about the above-mentioned mid-plane, or, in a variant, it may be non-symmetrical about the mid-plane. In some embodiments, two sides of a cross-section of the envelope surface may be non-symmetrical. In such embodiments, the sides may be different and may, for example, be concave, convex, or planar.

For at least one cross-section of the envelope surface, the core may define a center of symmetry of the cross-section.

The envelope surface of the brush may define at least one longitudinal ridge, e.g., two to eight longitudinal ridges. The ridges may be defined at the intersections of the faces defined by the envelope surface. In some embodiments, the ridges may be rectilinear, for example.

In some embodiments, the brush may comprise at least one undulated ridge.

The core may comprise at least two twisted metal strands. The strands may be twisted with a left-hand twist. In a variant, the strands may be twisted with a right-hand twist. The strands may have a diameter in the range of 0.35 mm to 1 mm, for example.

The applicator may comprise a twisted core defining turns, the bristles being engaged between the turns.

By way of example, the brush may comprise 5 to 80 bristles per turn, for example, 5 to 40 bristles per turn or 10 to 50 bristles per turn. In some embodiments, the brush may comprise 5 to 20 bristles per turn. In other embodiments, the brush may comprise more than 40 bristles per turn. The number of bristles per turn may correspond to the number of bristle ends counted by a stationary observer while the brush turns through 180° about its core.

The applicator may comprise at least two bristles of different diameters. The bristles may have a greatest transverse dimension in the range of 65 micrometers (μm) to 400 μm, for example. The applicator may comprise at least one bristle made of an elastically-deformable material, such as an elastomer.

The brush may comprise at least two deformed bristles that are engaged between two adjacent turns of the core. Each bristle may have a removal of material or a flattening at at least one point along its length from the core, and may extend outwards, non-radially, from the point, as described in U.S. application No. 2004/0240926, the content of which is incorporated herein by reference. Each deformed bristle may comprise two rectilinear portions forming a bend between them. The two rectilinear portions may have the same cross-section. In some embodiments, all of the deformed bristles may define bends that are situated substantially at the same distance from the core.

The applicator may comprise at least one bristle comprising a compound, e.g., a particulate or other compound. In some embodiments, the compound may facilitate sliding of the bristle over keratinous fibers. In other embodiments, the compound may create a surface roughness to catch the fibers more strongly.

The applicator may comprise a mixture of bristles.

The applicator may comprise at least one bristle presenting at least one undulation. For example, in some embodiments, the applicator may comprise at least two bristles, each comprising at least one periodic pattern including at least one undulation, wherein at least two of the periodic patterns are different. The two different periodic patterns may belong to two distinct bristles or to the same bristle, and the undulations may have different shapes, (e.g., a sawtooth shape or a sinusoidal shape) or different amplitudes, or different spatial frequencies. The expression "periodic pattern" means, within a bristle, a portion of the bristle that is substantially reproduced, in periodic manner, along the bristle.

The applicator may comprise bristles that are made other than by being injection-molded with the core. The brush may comprise at least one portion having curved bristles extending in oriented manner from the core, e.g. as described in U.S. application No. 2004/0168698. The term "extending in oriented manner" means that the curved bristles extend with a general orientation that is defined during manufacture of the brush, and they do not extend with completely random orientations. In particular, the bristles may be oriented in the same circumferential direction around the core. The bristles of the brush may be curved by contact with a hot surface, in particular a surface moving relative to the brush.

The applicator may comprise twisted bristles, e.g. as described in U.S. Pat. No. 6,390,708.

The disclosed applicator may comprise a stem having a distal portion with a longitudinal axis, and a brush having a core with rectilinear portion. The core may have a longitudinal axis that coincides with the longitudinal axis of the distal portion of the stem. In some embodiments, the longitudinal axis of the entire stem may be completely rectilinear.

The core of the brush may be fastened rigidly to the stem, or, in a variant, it may be fastened by an elastically-deformable connection, e.g. with a flexible portion made of a material that is different from the remainder of the stem, e.g. an elastomer material.

The core of the brush may comprise an end that is fastened to the stem, e.g., that is inserted in a housing formed at a free end of the stem.

The stem may be connected to a handle. The handle may be arranged to close, in a leak-tight manner, a receptacle containing the composition for application. For example, in some embodiments, the handle may comprise a threaded mounting skirt that is arranged to be screwed on a neck of the receptacle.

A packaging may be provided with the applicator device for applying a composition to eyelashes or eyebrows. For example, in some embodiments, the packaging may comprise a receptacle containing the composition for application, and may be provided with an applicator as defined above. The composition may be mascara, for example.

The receptacle may comprise a wiper configured to wipe the brush while it is being removed from the receptacle. For example, the wiper may be fastened in the neck of the receptacle. The wiper may comprise a wiper lip made of elastomer, for example. In some embodiments, the wiper may be flocked.

In another aspect, the present disclosure may be directed to a method of manufacturing any of the applicators described herein. The method may include machining a brush blank having a core that comprises at least one rectilinear portion and defines a substantially cylindrical envelope surface, wherein the machining is performed to form at least one first face that extends longitudinally in a sloping manner relative to the longitudinal axis of the core. The method may also comprise forming, on the blank, at least one second face that extends longitudinally parallel to the longitudinal axis of the core.

In some embodiments, each of the faces may be substantially planar. In such embodiments, the two faces may be substantially perpendicular.

Machining the blank may create an envelope surface of flat cross-section at at least one point along the core, for example, over at least half, or even all of the length of the rectilinear portion of the core.

In another aspect, the present disclosure also provides a method of applying makeup to eyebrows or to a set of eyelashes. This method may comprise applying makeup with any of the applicators described herein, to a first end of the eyebrows or to a first end of the set of eyelashes using a first set of bristles. The method also may include turning the applicator about its own axis through an angle that is greater than one fourth of a turn, to apply makeup to a second end of the eyebrows or of the set of eyelashes using a second set of bristles distinct from the first set of bristles.

The first and second sets of bristles may define, at least in part, the above-mentioned first and second faces.

Aside from the arrangements set forth above, the invention could include a number of other arrangements such as those explained hereinafter. It is to be understood that both the foregoing description and the following description are exemplary only.

BRIEF DESCRIPTION OF THE DRAWINGS

The disclosed device can be better understood by reading the following detailed description of non-limiting embodiments thereof, and by examining the accompanying drawings, which form an integral part of the description, and in which.

MORE DETAILED DESCRIPTION

Figure 1:
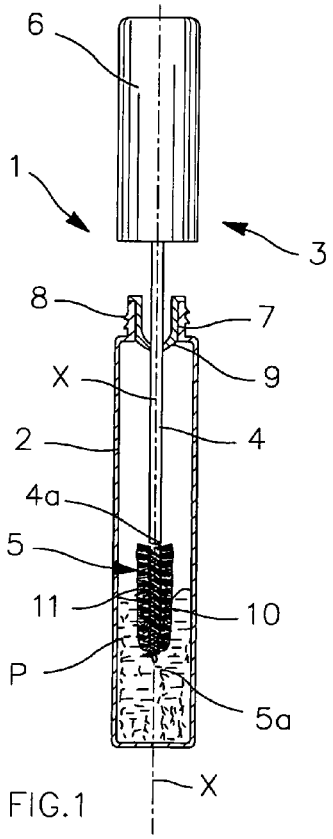
FIG. 1 is diagrammatic view in elevation, and partially in axial section, showing an embodiment of a system for applying a composition to eyelashes or eyebrows including a receptacle and an applicator.

FIG. 1 shows a system 1 comprising: a receptacle 2 containing a composition P for application to eyelashes and/or eyebrows, e.g. mascara, and an applicator 3 comprising: a stem 4, e.g. of circular cross-section, that is provided at its distal end 4*a* with a brush 5 and that is connected at its proximal end to a handle 6 that also constitutes a closure cap for closing the receptacle 2. The receptacle may be fitted with a wiper 7, e.g. constituted by a part made of elastomer that is inserted in the neck 8 of the receptacle. The wiper 7 can, in some embodiments, be adjustable.

In the embodiment shown in FIG. 1, the stem 4 presents a rectilinear longitudinal axis X that coincides with the axis of the neck 8 of the receptacle 2 when the applicator is in place in the receptacle.

The handle 6 may be configured in the form of a cap that may be screwed tight, to close the receptacle 2 on the neck 8 in a leak-tight manner.

In the embodiment shown, the wiper 7 includes a wiper orifice 9 of circular cross-section, having a diameter that corresponds substantially to the diameter of the stem 4.

The brush 5 includes a core 10 formed by two twisted metal strands, the core 10 having a proximal portion that is fastened in a housing of the stem 4, e.g. being friction-fit in the housing. By way of example, the two strands result from folding a wire in half.

The strands of the core can have a diameter in the range of 0.35 mm to 1 mm, for example.

Figure 49:
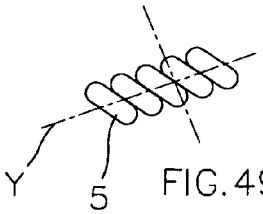
FIGS. 49 and 50 show twisted cores respectively having left-hand and right-hand twist.
Figure 50:
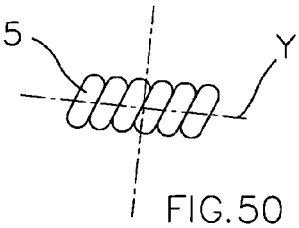

The strands of the core can be given a left-hand twist or a right-hand twist. Thus, the brush can have a left-hand or right-hand twist. For example, FIG. 49 shows the brush 5 with a core having a left-hand twist, and FIG. 50 shows a brush with a core having a right-hand twist. Reference can be made to European patent EP 0 611 170.

The core 10 includes a rectilinear portion 10*a* that extends along the longitudinal axis X of the stem 4.

Figure 3:
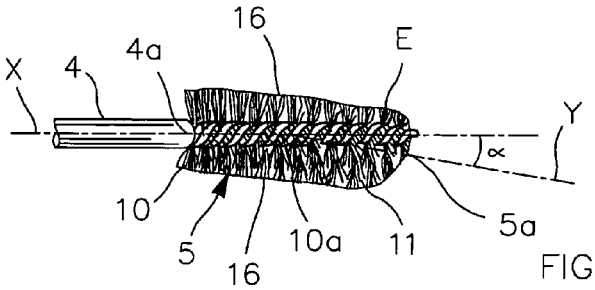
FIGS. 3 and 4 are fragmentary views showing the applicator of FIGS. 1 and 2 as viewed along perpendicular directions III and IV respectively of FIG. 2.
Figure 4:
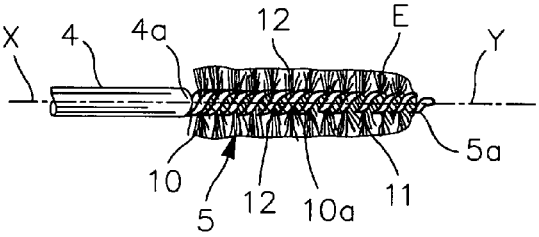

Referring to FIGS. 3 and 4, the rectilinear portion 10*a* includes bristles 11 that are held by being clamped between the twisted strands of the core 10 and that extend substantially radially from the core.

Figure 2:
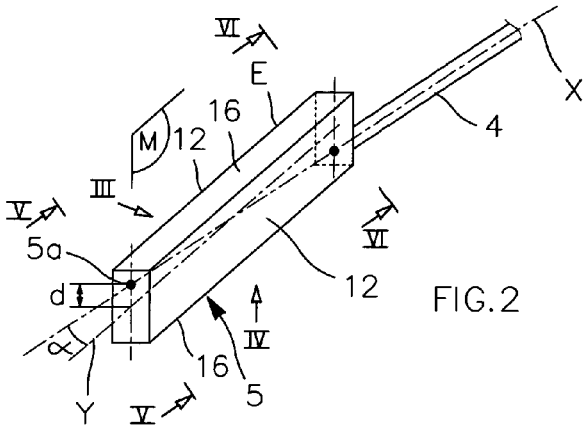
FIG. 2 is a diagrammatic, fragmentary perspective view showing the applicator of the FIG. 1 system.

FIG. 2 shows the envelope surface E defined by the free ends of the bristles 11 of the brush 5.

Figure 5:
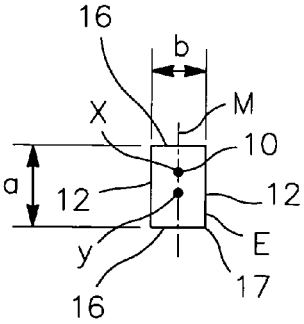
FIGS. 5 and 6 are cross-sections on V-V and VI-VI respectively of the FIG. 2 applicator.
Figure 6:
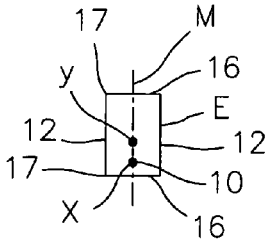

The envelope surface E of the brush 5 is flattened along a mid-plane M, as can also be seen in FIGS. 5 and 6.

The term "flattened along the mid-plane M" should be understood as meaning that the maximum dimension a of the cross-section parallel to the mid-plane is greater than the maximum dimension b perpendicular to the mid-plane M.

In the embodiment shown, the envelope surface E defines two opposite faces 12 that extend substantially parallel to the axis X, as can be seen in FIG. 4, and two opposite faces 16 that extend substantially non-parallel to the axis X, as can be seen in FIG. 3. The envelope surface E of the brush 5 is thus off-center relative to the core 10.

The longitudinal axis of the core 10 extends entirely in the mid-plane M in the embodiment under consideration, and the core is the most off-center at the axial ends of the rectilinear portion carrying the bristles In a variant, the off-centering could be at its greatest other than at an axial end of the brush, e.g. at its middle, or even in a distal or proximal first half of the brush.

In the example shown, the envelope surface E extends along a rectilinear longitudinal axis Y that is not parallel to the axis X, forming an angle $\alpha$ with the axis X. The longitudinal axes X and Y are contained in the mid-plane M.

Given the length of the brush 5, the angle $\alpha$ can be small enough for the brush not to come into contact with the inside surface of the receptacle 2 when the applicator is in place inside the receptacle 2. It is not beyond the ambit of the present disclosure, however, for the receptacle 2 to have dimensions such that the brush 5 does come into contact with the surface.

The angle $\alpha$ may be in the range of 1° to 8°, for example.

The angle $\alpha$ may establish a distance d between the axis X and the axis Y at the free end 5*a* of the brush, as shown in FIG. 2. In some embodiments, the distance d is not greater than 4.5 mm, e.g. about 3 mm. The distance d depends on the length of the brush and can be greater than 4.5 mm without going beyond the ambit of the present disclosure.

In the embodiment under consideration, the core 10 includes bristles 11 along substantially the entire length of the rectilinear portion 10*a*. In a variant, the rectilinear portion may be free of bristles over a certain distance from the stem 4.

In the embodiment under consideration, the faces 12 and 16 of the envelope surface are substantially planar, as can be seen in FIGS. 2 and 3.

The envelope surface E can present a truncated distal portion having a pyramid or cone shape, as shown in FIG. 3. The same could apply in the proximity of the stem 4, so as to make it easier for the brush to pass through the wiper 7.

In order to make the brush 5, it is possible, for example, to start with a brush blank of envelope surface that is circularly cylindrical about the axis X of the stem, the longitudinal axis of the envelope surface of the blank being rectilinear and coinciding with the axis X.

The blank can be machined in order to give it a cross-sectional shape that is off-center relative to the core.

In particular, it is possible to cut the brush by means of a cutter head that is rotated about an axis of rotation that is perpendicular to the longitudinal axis of the stem, in such a manner as to form the planar faces 12 and 16 and the distal portion, the planar faces 16 forming an angle with the longitudinal axis X of the core 10.

During manufacture of the brush, it is possible to machine a first side, then turn the brush, each time through one fourth of a turn, about its longitudinal axis X, relative to the cutter head, so as to machine the next side. In a variant, it can be the cutter head that is displaced relative to the brush, or both the cutter head and the brush that are displaced.

By way of example, a first one of the faces 16 can be machined in such a manner that, when heading in a direction towards the stem 3, the first of the faces 16 comes closer to the core. The second of the faces 16 that is opposite from the first face can be machined in such as manner that, when heading in a direction away from the stem 4, the second of the faces 16 comes closer to the core 10.

The blank can be cut even after the core has been fastened to the stem. In a variant, however, the brush may be machined before being fastened to the stem.

In order to apply makeup, the user unscrews the applicator and removes the brush 5 from the receptacle 2.

The user can use one of the planar faces 12 that extends parallel to the longitudinal axis X of the stem to apply the composition P to eyelashes or eyebrows and/or to comb the eyelashes or eyebrows.

Where appropriate, the user can also turn the brush 5 about its axis X.

Figure 7:
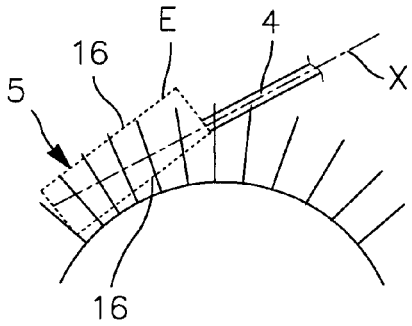
FIGS. 7 and 8 show the use of the applicator in FIGS. 1 to 6 for applying makeup to a set of eyelashes.

One of the faces 16 makes it possible to apply makeup to a first end of the set of eyelashes, in particular the first of the faces 16 (i.e., the face that has been machined in such a manner as to come closer to the core when heading in a direction towards the stem 4, as can be seen in FIG. 7. Such a face 16 is defined, in the proximity of the end of the brush 5, by longer bristles that make it possible to enter properly into contact with the eyelashes at the left-hand end of the set of eyelashes.

In a subsequent step, the user can turn the brush about the axis X through one half of a turn, in such a manner as apply to the eyelashes, the face 16 that is opposite from the first, i.e. the face 16 that is machined in such as manner as to come closer to the core when heading in a direction away from the stem 4.

Figure 8:
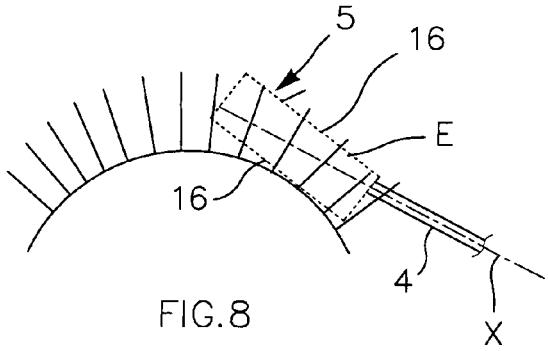

The second face 16 is defined by longer bristles in the proximity of the end of the brush 5 close to the stem 4, the bristles enabling better engagement of the eyelashes at the righthand end of the set of eyelashes, as shown in FIG. 8.

Thus, some embodiments of the disclosed brush may facilitate combing and curling of eyelashes, in particular of eyelashes at the ends of a set of eyelashes, by enabling the bristles of the brush to penetrate better into the set of eyelashes.

Finally, while applying makeup, the ridges 17 defined by the ends of the faces 12 and 16 can make it easier to separate eyelashes that may possibly become stuck together as a result of too much composition in certain places.

Various modifications can be applied to the applicator, and in particular to the brush, without going beyond the ambit of the present disclosure.

In the embodiment in FIGS. 1 to 6, the brush blank initially may be circularly cylindrical.

Figure 9:
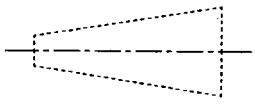
FIGS. 9 to 12 are longitudinal section views of examples of envelope surfaces of brush blanks that may be used to create applicators in accordance with the disclosed device.
Figure 10:
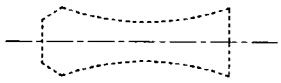
Figure 11:
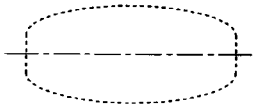
Figure 12:
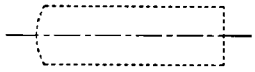

Alternatively the brush blank initially may have other shape in longitudinal section. By way of example, the longitudinal section of the blank can be triangular or trapezoidal as shown in FIG. 9, hourglass-shaped as shown in FIG. 10, lenticular as shown in FIG. 11, or rectangular as shown in FIG. 12.

Such shapes for blanks make it possible to obtain faces that are optionally planar, concave, or convex, for example.

In addition, the envelope surface E of the brush 5 could present a cross-section that is rectangular, as shown in FIGS. 1 to 6.

Figure 13:
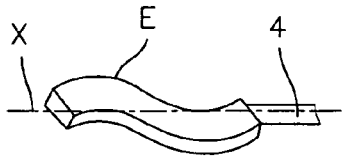
FIG. 13 is a diagrammatic, fragmentary perspective view of a variant embodiment.

FIG. 13 shows an embodiment comprising an envelope surface E of cross-section that is rectangular, the envelope surface having an undulating shape in plan view, when observed perpendicularly to the flat mid-plane M. In this exemplary embodiment, the brush comprises at least one undulated ridge, having at least one point of inflexion, in particular at least two. In some embodiments, the ridge may define a face of constant width.

In a variant, the envelope surface E of the brush could present another shape in cross-section at at least one point along its length, as shown in FIGS. 14 to 25.

Figure 14:
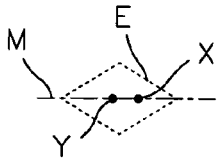
FIGS. 14 to 25 are cross-sectional views of exemplary envelope surfaces.
Figure 15:
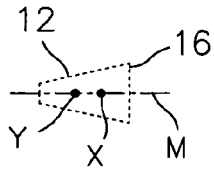
Figure 18:
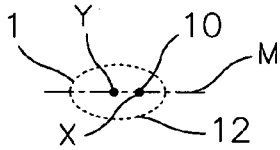

By way of example, the cross-section of the envelope surface can be lozenge-shaped as shown in FIG. 14, or it could be trapezoid-shaped as shown in FIG. 18.

Figure 16:
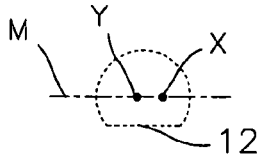

By way of example, the brush can also include an envelope surface of circular cross-section with at least one flat, as shown in FIG. 16. The flat can define the face 12 having a generator line that is parallel to the longitudinal axis X of the stem 4.

In some of the embodiments described above, the face 12 is planar, but it is not beyond the ambit of the present disclosure for the face 12 to be defined by a generator line that is moved parallel to the longitudinal axis X along a non-rectilinear path.

Figure 17:
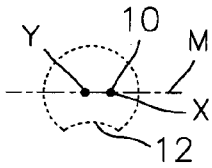

By way of example, FIG. 17 shows a brush including at least one concave face 12 having a generator line that is parallel to the axis X, and FIG. 18 shows a brush with at least one convex face 12. In FIG. 18, it can be seen that the brush can present an envelope surface of cross-section, at at least one point along the core, that is oblong, in particular lens-shaped.

Figure 19:
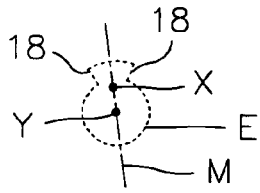

At least one longitudinal section of the envelope surface E of the brush can be keyhole-shaped, as shown in FIG. 19.

Figure 20:
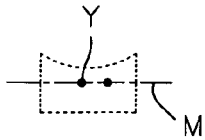
Figure 21:
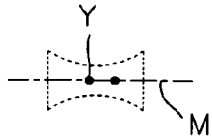

Still in a variant, a cross-section of the brush can present a convex side, as shown in FIG. 20, or two opposite convex sides, as shown in FIG. 21, with the cross-section of the brush being, in this event, symmetrical about the mid-plane M, while in the embodiment in FIG. 20, the cross-section of the brush is asymmetrical about the mid-plane M.

Figure 22:
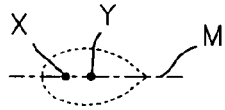

The cross-section of the brush can also be in the shape of an airplane wing, as shown in FIG. 22.

Figure 23:
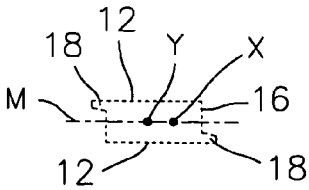
Figure 24:
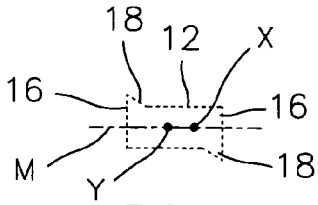

Still in a variant, at least one of the sides of the cross-section can define at least one step that extends outwards in register with a face 12, as shown in FIG. 23, or outwards in register with faces 16, as shown in FIG. 24.

Figure 25:
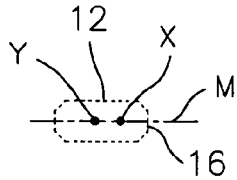

Finally, the ridges 17 between the faces 12 and 16 can be truncated, as shown in FIG. 25.

In general, the brush can present an optionally-constant cross-section over the major fraction of its length, or even over its entire length.

Any kind of bristles can be used in a brush made in accordance with the invention. In some embodiments a mixture of bristles of different kinds may be used. In other embodiments, a mixture of bristles of different lengths, and/or of the same kind, may be used.

By way of example, the brushes may be made with bristles of circular section, of diameter in the range of 65 μm to 400 μm.

Figure 26:
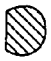
FIGS. 26 to 43 show various examples of bristle cross-sections.
Figure 27:
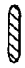
Figure 28:
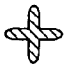
Figure 29:
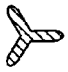
Figure 30:
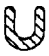
Figure 31:
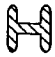
Figure 32:
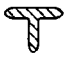
Figure 33:
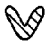
Figure 34:
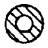
Figure 35:
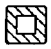
Figure 36:
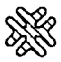
Figure 37:
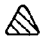
Figure 38:
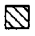
Figure 39:
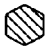
Figure 40:
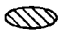
Figure 41:
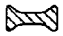
Figure 42:
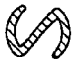
Figure 43:
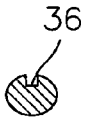

It is possible to use bristles that are solid or hollow. The bristles may have a solid circular cross-section, or have, in cross-section, one of the shapes shown diagrammatically in FIGS. 26 to 43. For example, the bristles may have a circular shape with a flat as shown in FIG. 26, a flat shape as shown in FIG. 27, a star shape, e.g. a cross shape, as shown in FIG. 28 or may have three branches as shown in FIG. 29. The bristles may be U-shaped as shown in FIG. 30, H-shaped as shown in FIG. 31, T-shaped as shown in FIG. 32, V-shaped as shown in FIG. 33, a hollow shape, e.g. circular as shown in FIG. 34 or square as shown in FIG. 35, forming branch members, e.g. snowflake-shaped as shown in FIG. 36, of prismatic section, e.g. triangular as shown in FIG. 37, square as shown in FIG. 38, hexagonal as shown in FIG. 39, oblong-shaped, e.g., lenticular as shown in FIG. 40, or hourglass-shaped as shown in FIG. 41. It is possible to use bristles having portions that are hinged relative to one another, as shown in FIG. 42. It is also possible to use bristles that present at least one capillary channel 36, as shown in FIG. 43.

Figure 44:
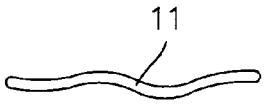
FIG. 44 shows a side view of an undulating bristle.

Before being put into place between the strands of the core, the bristles 11 that are held between the twisted strands of the core can present a rectilinear shape, e.g. an undulating shape, as shown in FIG. 44.

Figure 45:
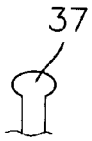
FIGS. 45 to 48 are fragmentary, diagrammatic views of exemplary bristles.
Figure 46:
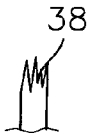

The bristles can be subjected to a treatment that seeks to form, at their ends, beads 37, as shown in FIG. 45, or spikes 38, as shown in FIG. 46.

Figure 47:
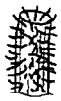
Figure 48:
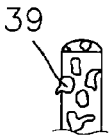

It is possible to use flocked bristles, as shown in FIG. 47, or even bristles that are made by extruding a plastics material containing a filler of particles 39, e.g. particles of a moisture-absorbing material, so as to impart a micro-relief to the surface of the bristles, as shown in FIG. 48, or so as to give them magnetic or other properties.

The bristles can also be made with a material having properties that facilitate sliding and/or provide elasticity.

The bristles can be natural or synthetic, and they can, for example, be made of a material such as: polyethylene (PE); polyamide (PA), in particular PA6, PA6/6, PA6/10, or PA6/12; HYTREL®; PEBAX®; silicone; and/or polyurethane (PU).

Figure 51:
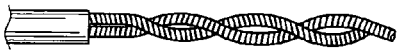
FIG. 51 diagrammatically shows a double core that is formed by twisting together two individual twisted cores.

The core can also be a double core, formed by two individual cores that are twisted together, as shown in FIG. 51. Each individual core can comprise two strands that are twisted together, trapping bristles. Each of the two individual cores can constitute a branch of a single twisted core that is folded in a U-shape, wherein the two branches are twisted together.

The bristles of the brush can be subjected to an abrading, grinding, stamping, or hot-melting treatment, in particular at the end of the bristles.

Figure 52:
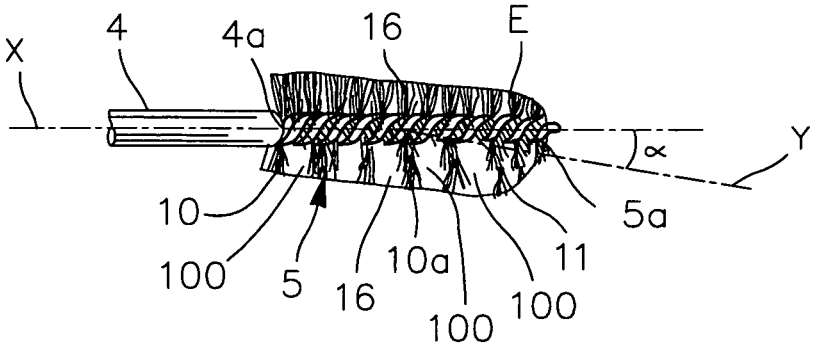
FIGS. 52 and 53 are views similar to FIG. 3 showing variant embodiments.

FIG. 52 shows a brush wherein a succession of setbacks 100 has been made. The setbacks 100 extend on one side of the core when the brush is observed from the side, as in FIG. 52.

The setbacks 100 make it possible to form, between bunches of bristles, gaps that enable the brush to behave like a comb on the side including the setbacks. On the side including the setbacks, the outline of the envelope surface can be rectilinear in side view, as in FIG. 52.

Figure 53:
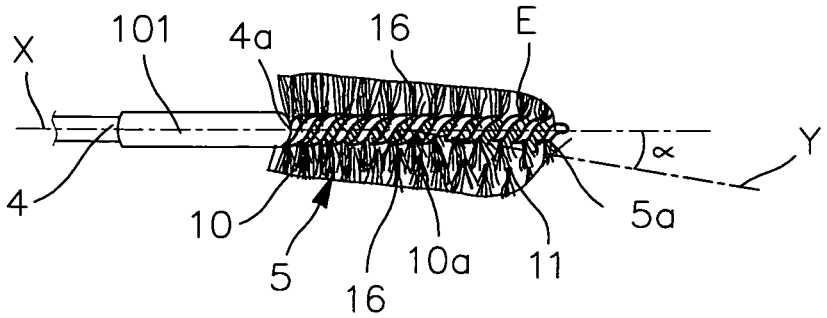

FIG. 53 shows an exemplary embodiment, wherein the brush is fastened to, or molded on, a flexible portion 101 made of elastomer. This flexible portion 101 may impart flexibility during application of a composition to eyebrows or eyelashes and during extraction of the brush from the receptacle.

The disclosed device is not limited to the embodiments described above.

The brush could include one or more setbacks that could extend as far as the core of the brush.

The term "comprising a" should be understood as being synonymous with "comprising at least one" unless specified to the contrary.

Although the disclosed applicator has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the invention.

What is claimed is:

1. An applicator for applying a composition to at least one of eyelashes and eyebrows, comprising:

a brush that comprises a core including a rectilinear portion having a core longitudinal axis; and bristles extending from the rectilinear portion of the core, the bristles having free ends defining an envelope surface extending along an envelope longitudinal axis; wherein the envelope longitudinal axis is not parallel to the core longitudinal axis;

the envelope surface has at least one portion along the envelope longitudinal axis and a cross-section of this portion has a shape that is flattened along a mid-plane;

the envelope surface defines a truncated distal portion and at least one surface that is at least partly circularly cylindrical along the core longitudinal axis, further defines first and second planar opposite faces that are not parallel to the core longitudinal axis, and is non-symmetrical about the mid-plane; and the core is off-center with respect to the envelope surface at least at each axial end of the brush.

2. An applicator according to claim 1, wherein the mid-plane contains the core longitudinal axis and the envelope longitudinal axis.

3. An applicator according to claim 1, wherein the envelope longitudinal axis forms an angle in the range of 1° to 8° with the core longitudinal axis.

4. An applicator according to claim 1, wherein the core is centered with respect to the envelope surface at at least one cross-section of the envelope surface.

5. An applicator according to claim 1, wherein the envelope surface defines at least one face that is not parallel to the core longitudinal axis.

6. An applicator according to claim 1, wherein the envelope surface defines two opposite faces that are parallel to the core longitudinal axis.

7. An applicator according to claim 6, wherein at least one of the two opposite faces is substantially concave or convex.

8. An applicator according to claim 1, wherein the envelope surface defines at least one planar face that is parallel to the mid-plane.

9. An applicator according to claim 1, wherein the envelope surface is of constant cross-section over at least a majority of the length of the rectilinear portion of the core.

10. An applicator according to claim 1, wherein the envelope surface is of non-constant cross-section over at least a majority of the length of the rectilinear portion of the core.

11. An applicator according to claim 1, wherein at at least one point along the rectilinear portion of the core, the cross-section of the envelope surface has a shape selected from circular, polygonal, lozenge-shaped, oblong, oval, lenticular, wedge-shaped, pear-shaped, keyhole-shaped, or stepped.

12. An applicator according to claim 1, wherein at at least one point along the rectilinear portion of the core, the cross-section of the envelope surface has a shape selected from triangular, rectangular, square, pentagonal, and hexagonal.

13. An applicator according to claim 1, wherein the envelope surface defines at least one longitudinal ridge.

14. An applicator according to claim 1, further comprising at least one undulated ridge.

15. An applicator according to claim 1, wherein the core comprises at least two twisted metal strands.

16. An applicator according to claim 1, further comprising a stem having a distal portion having a longitudinal axis, wherein the core coincides with the longitudinal axis of the distal portion of the stem.

17. An applicator according to claim 1, further comprising, at a distal end, bristles of different lengths having different flexibilities.

18. An applicator according to claim 1, further comprising a mixture of bristles having at least one of differing diameters, differing kinds of bristles, and differing cross-sections.

19. An applicator according to claim 1, wherein the brush comprises, on one side of the core, gaps between the bristles.

20. An applicator according to claim 1, further comprising bristles that are treated by stamping or grinding.

21. An applicator according to claim 1, wherein the brush is molded or mounted on a flexible portion.

22. A system for applying a composition to eyelashes or eyebrows, comprising:

a receptacle containing the composition; and an applicator according to claim 1.

23. A method of manufacturing an applicator as defined in claim 1, comprising:

machining a brush blank having a core that comprises at least one rectilinear portion and defines a substantially cylindrical envelope surface, the machining being performed so as to form at least one first face that extends longitudinally in sloping manner relative to a longitudinal axis of the core; and forming, on the blank, at least one second face that extends longitudinally parallel to the longitudinal axis of the core.

24. A method of applying makeup to eyebrows or to a set of eyelashes, comprising:

applying makeup to a first end of the eyebrows or a first end of the set of eyelashes using a first set of bristles of the applicator defined in claim 1;

turning the applicator through an angle that is greater than one fourth of a turn about the core longitudinal axis; and applying makeup to a second end of the eyebrows or a second end of the set of eyelashes using a second set of bristles distinct from the first set of bristles.

25. An applicator according to claim 1, wherein the first and second planar opposite faces that are not parallel to the core longitudinal axis are parallel to each other.

26. An applicator according to claim 1, wherein the envelope surface defines third and fourth planar opposite faces that are parallel to each other.

* * * * *